United States Patent [19]

Abe et al.

[11] Patent Number: 4,919,719

[45] Date of Patent: Apr. 24, 1990

[54] HIGH TEMPERATURE WEAR RESISTANT SINTERED ALLOY

[75] Inventors: Makoto Abe; Ichiro Tanimoto, both of Yokohama; Akira Fujiki, Yokosuka; Keitaro Suzuki; Hiroyuki Endo, both of Abiko; Yutaka Ikenoue, Matsudo, all of Japan

[73] Assignees: Nissan Motor Co., Ltd., Yokohama; Hitachi Powdered Metals Co., Ltd., Matsudo, both of Japan

[21] Appl. No.: 237,038

[22] Filed: Aug. 29, 1988

[30] Foreign Application Priority Data

Sep. 10, 1987 [JP] Japan ..... 62-225196

[51] Int. Cl.[5] ..... C22C 29/00

[52] U.S. Cl. ..... 75/243; 75/246; 419/2; 419/11; 419/23; 419/27; 419/36; 419/58

[58] Field of Search ..... 75/243, 246; 419/27, 419/23, 11, 36, 58, 2

[56] References Cited

U.S. PATENT DOCUMENTS

| | | | |
|---|---|---|---|
| 4,274,876 | 6/1981 | Kodama et al. | 75/243 |
| 4,422,875 | 12/1983 | Nakata et al. | 75/243 |
| 4,504,312 | 3/1985 | Oaku et al. | 75/244 |
| 4,546,737 | 10/1985 | Kazuoka et al. | 123/188 |
| 4,556,533 | 12/1985 | Oaku et al. | 419/11 |
| 4,734,968 | 4/1988 | Kuroishi et al. | 29/156.7 |
| 4,863,533 | 9/1989 | Hanakawa et al. | 148/141 |

FOREIGN PATENT DOCUMENTS 62-10244 1/1987 Japan .

*Primary Examiner*—Stephen J. Lechert, Jr.
*Assistant Examiner*—Nina Bhat
*Attorney, Agent, or Firm*—Foley & Lardner, Schwartz, Jeffery, Schwaab, Mack, Blumenthal & Evans

[57] ABSTRACT

A high temperature wear resistant sintered alloy suitable for the material of a valve seat in an automotive vehicle engine. The matrix of the sintered alloy consists essentially of carbon ranging from 0.45 to 1.15% by weight, nickel ranging from 5.4 to 27% by weight, molybdenum ranging form 0.4 to 2.7% by weight, cobalt ranging from 4.2 to 7.2% by weight and balance being substantially iron. The matrix is formed of a mixture of at least one of sorbite structure and bainite structure and austenite structure. Furthermore, the matrix includes hard phase dispersed therein and containing at least silicon, molybdenum and cobalt. The sintered alloy of such a structure can exhibit high strength and wear resistance at high temperatures regardless of type of engine and kind of fuel in case of being used as the material of the valve seat, while maintaining production cost thereof lower.

7 Claims, 3 Drawing Sheets

HIGH TEMPERATURE WEAR RESISTANT SINTERED ALLOY

BACKGROUND OF THE INVENTION

1. Field of the Invention

This invention relates generally to a sintered alloy very high in wear resistance at high temperatures, and more particularly to such a high temperature wear resistant sintered alloy to be used as the material of a valve seat in an automotive vehicle engine.

2. Description of the Prior Art

Recently, automotive vehicle engines have been improved in power output and other performances and therefore operated under very severe conditions. Accordingly, a valve seat of intake and exhaust valve mechanisms is also subjected to very severe temperature and wear conditions and required to be highly resistant to such a conditions. For example, in a LP-gas fueled engine mounted on taxicabs, valve and its valve seat are used in a dried condition or without liquid fuel, and therefore the valve seat is liable to earlier wear as compared with that of a gasoline fueled engine. Additionally, in cases of engines operated on a gasoline containing a high rate of lead compound so that sludge is adhered on the valve mechanism thereby to increase bearing pressure against the valve seat or in case of diesel engines operated in high temperature and high compression ratio, high wear resistance and such high strength as to prevent deformation of valve seat are required for the material of the valve seat.

Otherwise, although lash adjusters have been put into practical use to accomplish automatic adjustment of the position of the valve and valve operating timings in the event that the valve seat has weared, problem of shortened life of engines due to valve seat wear has not yet been solved. In view of the above and eager requirement of lowering production cost of the valve, valve seat material high in wear resistance at high temperatures has been required.

In this regard, a high temperature wear resistant sintered alloy was proposed as the material suitable for valve seats of LP-gas fueld engines and diesel engines, as disclosed in Japanese Patent Provisional Publication No. 62-10244. The matrix of this sintered alloy consists essentially of nickel ranging from 0.5 to 3% by weight, molybdenum ranging from 0.5 to 3% by weight, cobalt ranging from 5.5 to 7.5% by weight, carbon ranging from 0.6 to 1.2% by weight and balance being substantially iron. A hard phase is dispersed in a suitable amount in the matrix. The hard phase is formed of an intermetallic compound consisting essentially, of molybdenum ranging from 33 to 36% by weight, silicon ranging from 4 to 12% by weight and balance cobalt, or another intermetallic compound consisting essentially of molybdenum ranging from 26 to 30% by weight, chromium ranging from 7 to 9, silicon, ranging from 1.5 to 2.5% by weight and balance being cobalt. The above-mentioned Publication also discloses that the sintered alloy is infiltrated with lead so that the pores are filled with lead in order to further improve wear resistance of the sintered alloy, and that it is effective for the lead containing gasoline fueled engine and the diesel engine to re-compact the sintered alloy material thereby making its density higher.

Although such a sintered alloy is improved in high temperature wear resistance over other conventional materials for valve seat, it is still insufficient in material strength. In other words, the strength of the sintered alloy is insufficient for the material of valve seat in the lead containing gasoline fuel engine and the diesel engine. In this regard, re-compacting of the sintered alloy may improve the strength of the material but complicates production process and prolongs production time of the material, thus raising production cost per a unit weight of the material.

SUMMARY OF THE INVENTION

It is an object of the present invention to provide an improved sintered alloy high in material strength and high in wear resistance at high temperatures under low production cost.

Another object of the present invention is to provide an improved high temperature wear resistant sintered alloy suitable for a valve seat of an automotive engine regardless of type of engine and kind of fuel.

A fuel temperature wear resistance sintered alloy according to the present invention is comprised of a matrix which consists essentially of carbon ranging from 0.45 to 1.15% by weight, nickel ranging from 5.4 to 27% by weight, molybdenum ranging from 0.4 to 2.7% by weight cobalt ranging from 4.2 to 7.2% by weight, and balance being substantially iron. The matrix is formed of a mixture of at least one of sorbite structure and bainite structure and austenite structure. The matrix has a hard phase ranging from 5 to 25% by weight and dispersed in the matrix.

Accordingly, the sintered alloy exhibits a very high material strength and an excellent wear resistance throughout low and high temperature ranges as compared with conventional materials regardless of characteristics of engine and kind of fuel in case where it is used as a component part of an engine, thereby greatly contributing to automotive vehicle industries. Additionally, such a high quality sintered alloy can be produced at a sintering temperature lower than in conventional sintered alloys, thus attaining economical advantages.

DETAILED DESCRIPTION OF THE INVENTION

Figure 1:
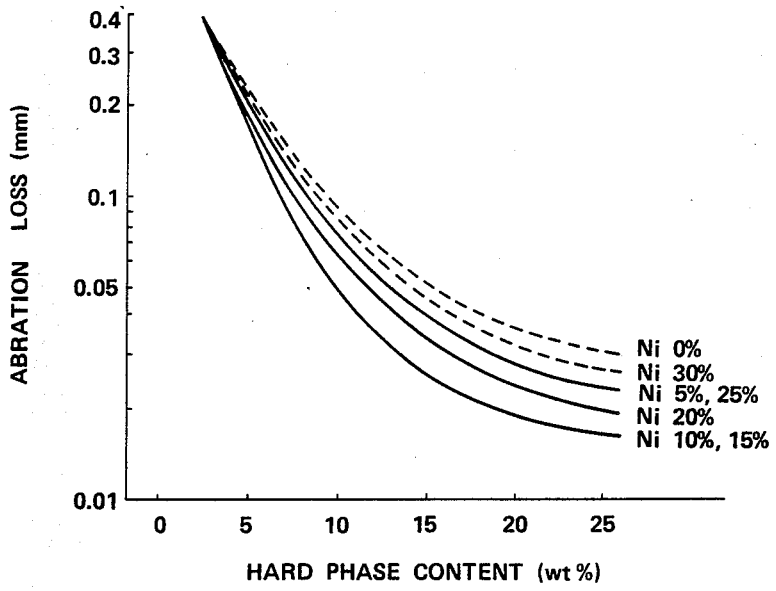
FIG. 1 is a graph showing the relationship between hard phase content and abrasion or wear loss upon altering carbonyl nickel content in sintered alloys.

According to a first aspect of the present invention, a high temperature wear resistant sintered alloy comprises a matrix consisting essentially of carbon ranging from 0.45 to 1.15% by weight, nickel ranging from 5.4 to 27% by weight, molybdenum ranging from 0.4 to 2.7% by weight, cobalt ranging from 4.2 to 7.2% by weight, and balance being substantially iron. The matrix is formed of a mixture of at least one of sorbite structure and bainite structure and austenite structure. The matrix has a hard phase (containing intermetallic compound) ranging from 5 to 25% by weight and dispersed in the matrix.

According to a second aspect of the present invention, a high temperature wear resistant sintered alloy consists essentially of carbon ranging from 0.3 to 1.1% by weight, silicon ranging from 0.2 to 3% by weight, nickel ranging from 5 to 27% by weight, molybdenum ranging from 1.9 to 12% by weight, cobalt ranging from 5 to 23% by weight, and balance being substantially iron. The sintered alloy comprises a matrix consisting essentially of carbon ranging from 0.45 to 1.15% by weight, nickel ranging from 5.4 to 27% by weight, molybdenum ranging from 0.4 to 2.7% by weight, cobalt ranging from 4.2 to 7.2% by weight, and balance being substantially iron. The matrix is formed of a mixture of at least one of sorbite structure and bainite structure and austenite structure. The matrix has a hard phase ranging from 5 to 25% by weight and dispersed in the matrix The hard phase consists essentially of silicon ranging from 4 to 12% by weight, molybdenum ranging from 33 to 36% by weight, and balance being substantially cobalt.

According to a third aspect of the present invention, a high temperature wear resistant sintered alloy consists essentially of carbon ranging from 0.3 to 1.1% by weight, silicon ranging from 0.1 to 0.75% weight, chromium ranging from 0.35 to 2.25% by weight, nickel ranging from 5 to 27% by weight, molybdenum ranging from 1.5 to 10% by weight, cobalt ranging from 5 to 23% by weight, and balance being substantially iron. The sintered alloy comprises a matrix consisting essentially of carbon ranging from 0.45 to 1.15% by weight, nickel ranging from 5.4 to 27% by weight, molybdenum ranging from 0.4 to 2.7% by weight, cobalt ranging from 4.2 to 7.2% by weight, and balance being substantially iron. The matrix is formed of a mixture of at least one of sorbite structure and bainite structure and austenite structure. The matrix has a hard phase ranging from 5 to 25% by weight and dispersed in the matrix. The hard phase consists essentially of silicon ranging from 2 to 3% by weight, chromium ranging from 7 to 9% by weight, molybdenum ranging from 26 to 30% by weight, and balance being substantially cobalt.

According to a fourth aspect of the present invention, a high temperature wear resistant sintered alloy having the same composition and structure as the sintered alloy according to the second aspect is infiltrated with lead so that the pores of the sintered alloy is filled with lead.

According to a fifth aspect of the present invention, a high temperature wear resistant sintered alloy having the same composition and structure as the sintered alloy according to the third aspect is infiltrated with lead so that the pores of the sintered alloy are filled with lead.

The high temperature wear resistant sintered alloy of the present invention will be discussed in detail hereinafter. In the sintered alloy according to the second and fourth aspects, the whole composition consists essentially of carbon ranging from 0.3 to 1.1% by weight, silicon ranging from 0.2 to 3% weight, nickel ranging from 5 to 27% by weight, molybdenum ranging from 1.9 to 12% by weight, cobalt ranging from 5 to 23% by weight, and balance being substantially iron. In the sintered alloy according to the third and fifth aspects, the whole composition consists essentially of carbon ranging from 0.3 to 1.1% by weight, silicon ranging from 0.1 to 0.75% by weight, chromium ranging from 0.35 to 2.25% by weight, nickel ranging from 5 to 27% by weight, molybdenum ranging from 1.5 to 10% by weight, cobalt ranging from 5 to 23% by weight, and balance being substantially iron. The above-mentioned content ranges of component elements have been determined for the reasons set forth below.

With respect to carbon (C), if its content is less than the above-mentioned lower limit value, the sintered alloy cannot exhibit a sufficient hardness and is low in wear resistance. On the contrary, if its content is more than the above-mentioned upper limit level, cementite is unavoidably crystallized out in the sintered alloy while deteriorating compactability of raw material powder of the sintered alloy thereby to increase abrasion of die for compacting. Additionally, for example in case where the sintered alloy is used as a valve seat, conformability of it with a valve is lowered. Thus, the content range of carbon has been determined as mentioned above.

With respect to silicon (Si), if its content is less than the above-mentioned lower limit value, deoxidation effect is less and therefore the degree of sintering is lowered. On the contrary, even if its content is more than the upper limit value, deoxidation effect cannot be improved while deteriorating compactability of raw material powder since the powder is rounded in shape. Thus, the content range of silicon has been determined as mentioned above. In this connection, in case where chromium is contained, the content of silicon is decreased.

With respect to nickel (Ni), if its content is less than the above-mentioned lower limit value, a sufficient strength of the material cannot be obtained. In this regard, the maximum material strength, can be obtained in case where the content of nickel is within a range from 10 to 15% by weight. On the contrary, if its content is more than the above-mentioned upper limit, the material strength is lowered. Thus, the content range of nickel has been determined as mentioned above.

With respect to molybdenum (Mo), if its content is less than the above-mentioned lower limit, effect of improving strength of the sintered alloy is less. On the contrary, if its content is more than the above-mentioned upper limit, oxidation resistance of the resultant sintered alloy is lowered. Thus, the content range of molybdenum has been determined as mentioned above. In this connecton, in case of containing chromium, the content of molybdenum is decreased.

With respect to cobalt (Co), if its content is less than the above-mentioned lower limit, the hardness of the resulting sintered alloy at an elevated temperaure is lower so that the sintered alloy tends to wear. On the contrary, if its content is more than the above-mentioned upper limit, the raw material powder is hardened thereby degrading compactability of the powder. Thus, the content range of cobalt has been determined as mentioned above.

In case of containing chromium (Cr), if its content is less than the above-mentioned lower limit value, effect of improving wear resistance is less; while if its content is more than the above-mentioned upper limit, the toughness of the resultant sintered alloy is lowered thereby increasing attacking ability against a valve in case the sintered alloy is used as the material of a valve seat. Thus, the content range of chromium has been determined as mentioned above.

The composition of the matrix of the high temperature wear resistant sintered alloy of the present invention consists essentially of carbon ranging from 0.45 to 1.15% by weight, nickel ranging from 5.4 to 27% by weight, molybdenum ranging from 0.4 to 2.7% by weight, cobalt ranging from 4.2 to 7.2% by weight, and balance being substantially iron. Additionally, a suitable amount of a hard phase is dispersed in the matrix formed of a mixture of at least one of sorbite structure and bainite structure and austenite structure. In this connection, in case where chromium is not contained, the hard phase consists essentially of silicon ranging from 4 to 12% by weight, molybdenum ranging from 33 to 36% by weight, and balance being substantially cobalt. The hard phase in an amount of 5 to 25% by weight is dispersed in the matrix preferably in the form of intermetallic compound, thus obtaining the sintered alloy. In case of containing chromium, the hard phase consists essentially of silicon ranging from 2 to 3% by weight, chromium ranging from 7 to 9% by weight, molybdenum ranging from 26 to 30% by weight, and balance being substantially cobalt. The hard phase in an amount of 5 to 25% by weight is dispersed in the matrix preferably in the form of intermetallic compound. Discussion will be made for the reason why such a hard phase having the above- mentioned specified composition is dispersed in the matrix having specified composition and structure.

With respect to carbon, if its content in the matrix is less than the above-mentioned lower limit value, the resultant sintered alloy exhibits an insufficient wear resistance. On the contrary, if its content in the matrix is more than the above-mentioned upper limit, conformability of the sintered alloy, used as the material of a valve seat, with a valve is deteriorated. Thus, the content of carbon has been determined as being within the range of 0.45 to 1.15% by weight.

With respect to nickel, if its content in the matrix is less than the above-mentioned lower limit value, strength of the material is low. On the contrary, even if its content in the matrix is more than the above-mentioned upper limit value, the material strength is low. Thus, the content of nickel has been determined as being within the range from 5.4 to 27% by weight.

With respect to molybdenum, if its content in the matrix is less than the above-mentioned lower limit value, effect of improving strength of the material is lower. Thus, the content of molybdenum has been determined as being within the range of 0.4 to 2.7% by weight.

With respect to cobalt, if its content in the matrix is less than the above-mentioned lower limit value, effect of improving wear resistance of the resultant sintered alloy is insufficient. On the contrary, if its content in the matrix is more than the above-mentioned upper limit value, compactability of the raw material powder is lowered. Thus, the content of cobalt has been determined as being within the range from 4.2 to 7.2% by weight.

Since the matrix is formed of the mixture of at least one of the sorbite structure and the bainite structure and the austenite structure, toughness of the whole matrix can be increased while attaining effect of suppressing wear of a valve contacting a valve seat formed of the sintered alloy.

Next, the composition of the hard phase will be discussed hereinafter. Concerning silicon, if its content in the hard phase is less than the abovementioned lower limit value, wear resistance is lower; while if its content is more than the abovementioned upper limit value, strength of the material is lower. Accordingly, the content range of the silicon in the hard phase has been determined a mentioned above. In this connection, in case of containing chromium in the hard phase, the content of silicon is decreased.

Concerning molybdenum, if its content in the hard phase is less than the above-mentioned lower limit value, wear resistance and strength of the resultant sintered alloy are insufficient. On the contrary, if its content is more than the above-mentioned upper limit, oxidation resistance of the resultant sintered alloy is lower. Accordingly, the content range of molybdenum on the matrix has been determined as mentioned above. In this connection, in case of containing chromium in the hard phase, the content of molybdenum is decreased.

Further, in case of containing chromium in the hard phase, effect of widening a temperature range to exhibit expected characteristics of the sintered alloy can be obtained. However, if the content of chromium is less than the above-mentioned lower limit value, the above-mentioned effect cannot be obtained; while if the content is more than the above-mentioned upper limit value, toughness of the resultant sintered alloy is lowered while increasing attacking ability against a valve in case where the sintered alloy is used as the material as a valve seat. Accordingly, the content range of the chromium has been determined as mentioned above.

In dispersion of the hard phase in the matrix, if the amount of the dispersed hard phase is less than the above-mentioned lower limit (5% by weight), abrasion loss of the sintered alloy is increased thereby to make wear resistance insufficient. On the contrary, even if the amount is more than the abovementioned upper limit (25% by weight), further improvement in wear resistance cannot be obtained while lowering strength of the material and deteriorating compactability of the raw material powder thereby causing die for compacting to wear down. Accordingly, the amount of the hard phase dispersed in the matrix has been determined as being within the range of from 5 to 25% by weight.

Furthermore, the high temperaure wear resistant sintered alloy of the present invention may be infiltrated with lead so that the pores of the sintered alloy are filled with lead, if necessary. This infiltration is, for example, carried out by dipping the sintered alloy in a bath containing molten metal under pressure, so that the pores of the sintered alloy is filled with lead. In this case, by infiltrating the sintered alloy, with lead in a suitable amount which may vary depending upon the total volume of the pores of the sintered alloy, lubricating ability and wear resistance of the sintered alloy can be effectively improved. In this connection, it is preferable to use the sintered alloy infiltrated with lead as the material of a valve seat used in a LP-gas fueled engine. In contrast, for a gasoline engine using a fuel containing lead compound in a higher content, it is preferable to use the sintered alloy which is not infiltrated with lead, as the material for the valve seat.

EXAMPLES

First, atomized ferro alloy powder of not larger than 100 mesh and containing 1.5% by weight of nickel, 1.5% by weight of molybdenum, and 6.5% by weight of cobalt was prepared as a main raw material. As a raw material for the hard phase to be dispersed in the matrix, an intermetallic compound powder consisting essentially of 35% by weight of molybdenum, 10% by weight of silicon and balance being substantially cobalt, and another intermetallic compound powder consisting essentially of 28% by weight of molybdenum, 8% by weight of chromium, 2% by weight of silicon and balance being substantially cobalt were prepared. Additionally, carbonyl nickel powder was prepared to form austenite structure.

Next, sample sintered alloys or valve seats for evaluation test were prepared as follows: To the above-mentioned atomized ferro alloy powder, the above-mentioned each intermetallic compound powder was added in an amount of 5% by weight, 10% by weight, 15% by weight, and 20% by weight together with a mixture powder of 1% by weight of graphite powder and 0.8% by weight of zinc stearate as lubricant, thereby preparing four kinds of mixture powders. The carbonyl nickel powder was blended in an amount of 5% by weight, 10% by weight, 15% by weight, and 20% by weight with each of the four kinds of the mixture powders, thus obtaining various kinds of sample powders. Each sample powder was compacted into a predetermined shape (or valve seat) upon regulating the density of compact so as to obtain a sintered density of 6.9 g/cm$^3$. The thus obtained compacts were subjected to sintering at 1200° C. for 20 minutes in an ammonia decomposition gas furnace, thus obtaining four kinds of the sample sintered alloys.

Subsequently, a part of each sample sintered alloy was dipped in a molten lead bath at 550° C. under a pressure of 8 atm. to infiltrate the sintered alloy with lead so that the pores of the sintered alloy was filled with lead.

COMPARATIVE EXAMPLES

First, atomized ferro alloy powder of not larger than 100 mesh and containing 1.5% by weight of nickel, 1.5% by weight of molybdenum, and 6.5% by weight of cobalt was prepared as a main raw material. As a raw material for the hard phase to be dispersed in the matrix, an intermetallic compound powder consisting essentially of 28% by weight of molybdenum, 8% by weight of chromium, 2% by weight of silicon and balance being substantially cobalt was prepared. Additionally, carbonyl nickel powder was prepared to form austenite structure.

Subsequently, sample sintered alloys or valve seats for evaluation test were prepared as follows: To the above-mentioned atomized ferro alloy powder, the above-mentioned intermetallic compound powder was added in an amount of 0% by weight, 5% by weight, 10% by weight, 15% by weight, 20% by weight and, 25% by weight together with a mixture powder of 1% by weight of graphite powder and 0.8% by weight of zinc stearate as lubricant, thereby to prepare six kinds of mixture powders. Then, the carbonyl nickel powder was blended in an amount of 0% by weight, 5% by weight, 10% by weight, 15% by weight, and 20% by weight 25% by weight, and 30% by weight with each of the six kinds of the mixture powders, thus obtaining various kinds of sample powders, avoiding preparation of sample powders which have the same proportion or blended ratio of the nickel carbonyl powder and the mixture powder as in the above-mentioned "Example". Each sample powder was compacted into a predetermined shape (or valve seat) upon regulating the density of compact so as to obtain a sintered density of 6.9 g/cm$^3$. The thus obtained compacts were subjected to sintering at 1200° C. for 20 minutes in an ammonia decomposition gas furnace, thus obtaining various kinds of sample sintered alloys.

Subsequently, a part of each sample sintered alloy was dipped in a molten lead bath at 550° C. under a pressure of 8 atm. to infiltrate the sintered alloy with lead so that the pores of the sintered alloy were filled with lead.

EVALUATION

Evaluation test was conducted on a variety of the valve seats or sample sintered alloys produced as Examples and Comparative Examples using a simultation engine tester, in order to compare abrasion loss of the respective valve seats. The simulation engine tester is so arranged that a cam shaft of a valve is driven by a motor, heating the valve and the valve seat at a predetermined temperature with burnt gas of LP-gas fuel, in which temperature of the valve and valve seat, revolution speed of the cam shaft and spring force applied to the valve can be suitably set thus accomplishing a severe test within a relatively short period of time. In this test, the material of the valve contactable with the valve seat is a heat resistant steel containing 21% of chromium and 4% of nickel (corresponding to so-called "21-4N").

Test was conducted on the valve seats or sample sintered alloys having the hard phases and nickel contents shown in Table 1, using the simulation engine tester in the temperature of the valve seat was set at 250° C. After continuous operation of the tester for 30 hours, the abrasion loss of each valve seat was measured to obtain test result shown in Table 1.

In addition, according to Z2500 of Japanese Industrial Standard, radial crushing strength was measured for each sample valve seat as shown in Table 1. In this connection, the radial crushing strength was obtained by measuring a load when crack was produced, upon pressing a cylindrical sample sintered alloy on two planes parallel with the axis of the sintered alloy.

TABLE 1

| Sample No. | Hard Phase | Carbonyl Ni (wt %) | Pb Infiltration | Abrasion (wear) loss (mm) | Radial crushing strength (kgf/mm$^2$) | Reference |
|---|---|---|---|---|---|---|
| 1 | B | 10 | NO | 0.089 | 115 | Example |
| 2 | A | 10 | NO | 0.079 | 117 | |
| 3 | B | 10 | YES | 0.070 | 118 | |
| 4 | A | 10 | YES | 0.060 | 118 | |
| 5 | A | 0 | NO | 0.125 | 70 | Comparative Example |
| 6 | A | 0 | YES | 0.100 | 75 | |

Note:
[1]Hard phase A is Co—28%Mo—8%Cr—2%Si and dispersed 15%.
[2]Hard phase B is Co—35%Mo—10%Si and dispersed 15%.
[3]Structure of matrix is Fe—6.5%Co—1.5%Ni—1.5%Mo—1%C throughout all sample sintered alloys.

As apparent from Table 1, the sintered alloys (Sample Nos. 1 to 4) according to the present invention are largely improved in wear resistance by adding a suitable amount of carbonyl nickel, as compared with comparative sintered alloy (Sample Nos. 5 and 6) outside the scope of the present invention. Furthermore, it is confirmed that infiltration of lead further improves the wear resistance of the sintered alloys according to the present invention. Moreover, the sintered alloys according to the present invention are also high in radial crushing strength as compared with the comparative sintered alloys.

Figure 2:
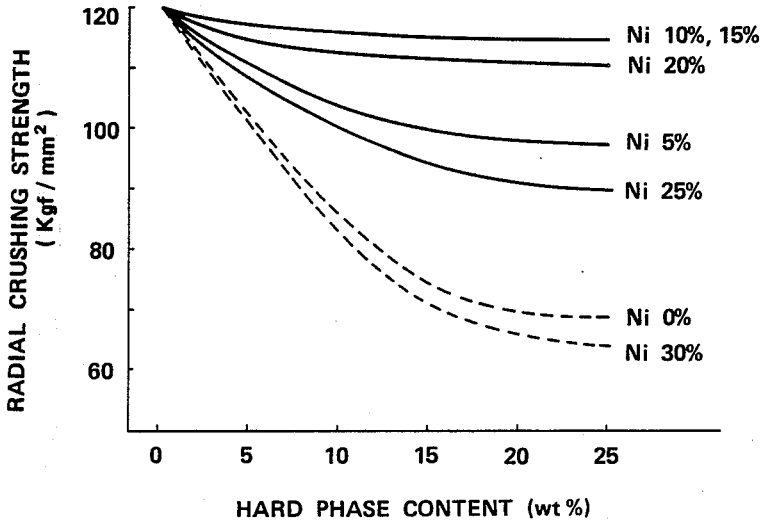
FIG. 2 is a graph showing the relationship between hard phase content and radial crushing strength upon altering carbonyl nickel content in sintered alloys.

Next, abrasion test was conducted in which the above-mentioned simulation engine tester was continuously operated for 30 hours, in which valve seats formed of the sintered alloys having the hard phase A dispersed and lead infiltrated were used as specimens, the valve seats were being kept at 350° C. After this continuous operation of the tester, abrasion loss of each valve seat (specimen) was measured. The thus measured abrasion or wear losses are shown in the graph of FIG. 1. Additionally, radial crushing strength of each specimen was measured and is shown in the graph of FIG. 2. Indication of "Ni %" in the graphs represents the percentage of addition of carbonyl nickel powder. A specimen of "Ni: 0%" corresponds to a comparative sintered alloy (outside the scope of the present invention) similar to the above-mentioned sintered alloy disclosed in Japanese Patent Provisional Publication No. 62-10244.

As apparent from the result shown in FIG. 1, wear resistance of the sintered alloy increases with increasing content of the hard phase added to the sintered alloy. However, it nearly does not change at the hard phase content over 25%.

Effect of nickel on abrasion or wear loss is such that abrasion loss of the sintered alloy decreases with increasing nickel content, in which the abrasion loss becomes the minimum in the vicinity of nickel content of 10 to 15% and again increases at the nickel content thereover to become nearly the same at the nickel content of 30% as at the nickel content of 0%. On comparison of abrasion or wear loss in case where the content of the hard phase is 15%, the specimen having 10% of nickel added is less 50% than the specimen having no nickel.

With reference to the graph of FIG. 2, the radial crushing strength of the sintered alloy increases with increasing content of the hard phase. Effect of nickel on the radial crushing strength is such that the radial crushing strength increases with increasing nickel content so that it becomes the maximum at the nickel content of 10 to 15% and lowers again at the nickel contents thereover to be lowered at the nickel content of 30% to a value which is lower than at the nickel content of 0%.

Accordingly, in order to avoid scattering in wear resistance of the resultant sintered alloys, the lower limit value of the hard phase has been determined as being 5% while the upper limit value has been determined as being 15%, in which the most preferable value is 15%. Addition of the hard phase over the upper limit value cannot contribute to improvement in wear resistance and deteriorates compactability of raw material powder of sintered alloy, so that die for compacting is liable to wear while raising production cost of the sintered alloy. In view of the above result in FIGS. 1 and 2, the lower limit value of nickel content has been determined as being 5% which includes nickel contained in the ferro alloy of the main raw material while the upper limit value has been determined as being 27% in which the most preferable value is 10%.

Subsequently, further abrasion test was conducted similarly to the above-mentioned abrasion test using the simulation engine tester and altering the temperature of the valve seat (specimen). The test result is shown in the graph of FIG. 3 in which a solid line indicates the specimens (according to the present invention) having a hard phase content of 15% and a nickel content of 10%, while a broken line indicates the comparative specimens (outside the scope of the present invention) having a hard phase content of 15% and a nickel content of 0%.

Figure 3:
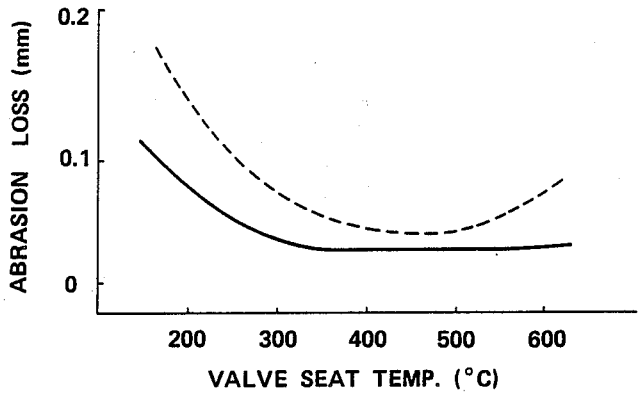
FIG. 3 is a graph showing comparison in abrasion or wear loss between valve seats formed of a sintered alloy of the present invention and a comparative sintered alloy in terms of temperature of valve seats.

As shown in the graph of FIG. 3, the comparative specimens indicate the maximum abrasion or wear loss at a temperature of 400° to 500° C. so as to exhibit a higher wear resistance at a low temperature range. In contrast, the specimens according to the present invention exhibit excellent wear resistance throughout low and high temperature ranges.

Figure 4:
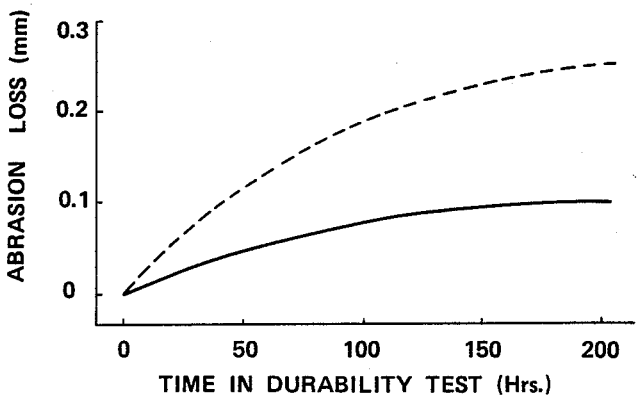
FIG. 4 is a graph showing comparison in abrasion or wear loss between the valve seats formed of the sintered alloy of the present invention and the comparative sintered alloy in terms of time in durability test.

Next, a bench durability test (abrasion test) was conducted using a four-cylinder type LP-gas fueled engine having a displacement of 2000 cc in which engine speed of the engine was constantly maintained at 6000 rpm. The compositions of the specimens used in this test were the same as those used in the test of FIG. 3, so that the specimens of solid and broken lines in FIG. 4 correspond to the those in FIG. 3, respectively. As apparent from the graph of FIG. 4, the specimens according to the present invention are less in abrasion loss after durability test than the comparative specimens. This demonstrates that the sintered alloys according to the present invention is excellent in durability.

Figure 5:
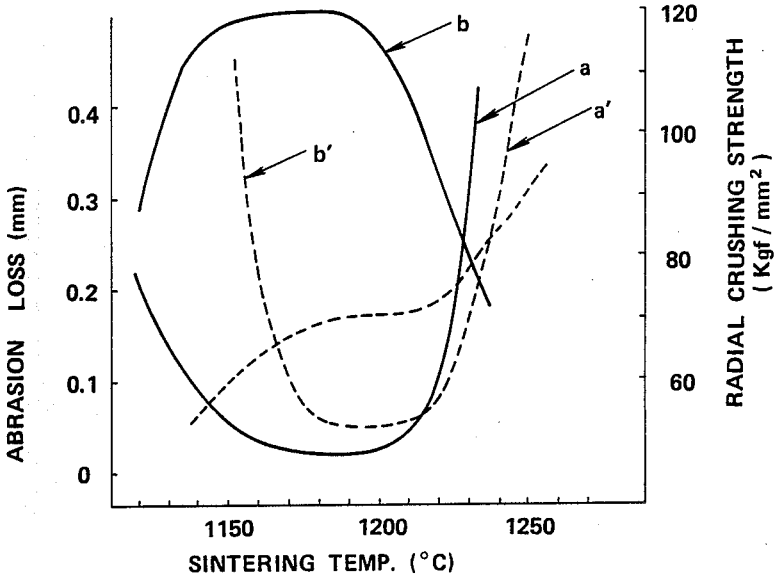
FIG. 5 is a graph showing effect of sintering temperature on radial crushing strength and abrasion or wear loss of sintered alloys.

Next, tests were conducted to determine a suitable condition for production of the sintered alloy, in which the relationship of sintering temperature and abrasion loss and radial crushing strength was obtained for the specimens according to the present invention and the comparative specimens which correspond respectively to those as shown in FIG. 3. Accordingly, solid and broken lines in FIG. 5 represent respectively the specimens according to the present invention and the comparative specimens, and therefore respectively correspond to the solid and broken lines in FIG. 3. Thus, in this test, the abrasion loss and the radial crushing strength were measured for the specimens which had been produced altering sintering temperature. Further, the lines a an a' indicate the abrasion or wear loss while the lines b and b' indicate the radial crushing strength.

As illustrated in the graph of FIG. 5, in the comparative specimens as indicated by the broken lines, the radial crushing strength increases with increasing sintering temperature; and the abrasion or wear loss is less and therefore the resultant sintered alloy is stable at a sintering temperture within a range of 40° C. whose center is 1200° C. In contrast, in the specimens according to the present invention as indicated by the solid lines, the radial crushing strength is higher at a sintering temperature within a range of 60° C. whose center is 1175° C.; and the abrasion or wear loss is less than in the above-mentioned comparative specimens. This demonstrates that addition of nickel provides a high radial crushing strength and a good effect in abrasion or wear loss even at a lower sintering temperature.

Figure 6:
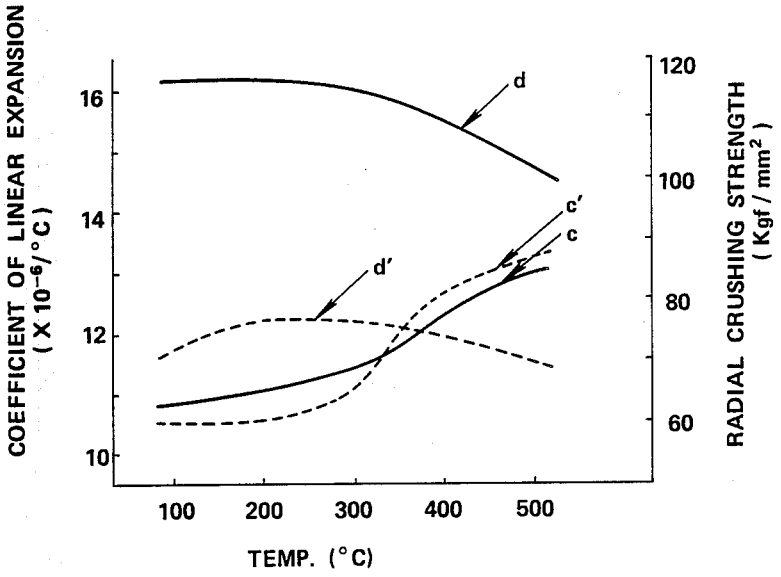
FIG. 6 is a graph showing effect of high temperature on radial crushing strength and coefficient of linear expansion in sintered alloys.

Further, mechanical property test was conducted using the specimens according to the present invention and the comparative specimens which were the same as those used in the test for FIG. 3. The test result is shown in FIG. 6 in which solid and broken lines represent respectively the specimens according to the present invention and the comparative specimens, and therefore correspond respectively to the solid and broken lines in FIG. 3. In FIG. 6, lines c and c' indicate coefficient of linear expansion while lines d and d' indicate the radial crushing strength.

The test result of FIG. 6 demonstrates that although there is a tendency that the radial crushing strength lowers at a high temperature range both in the specimens according to the present invention and the comparative specimens, the specimens according to the present invention maintain a very high level of the radial crushing strength. Additionally, the specimens according to the present invention and the comparative specimens are nearly the same in coefficient of linear expansion. This shows such an advantage of the sintered alloy of the present invention that there is no possibility of the valve seat falling off in case the valve seat is installed in an engine cylinder.

It is be noted that the ferro alloy used for producing the sintered alloy of the present invention contains nickel and molybdenum which mainly contribute to improvement in strength of the matrix. In this connection, if the content of each of nickel and molybdenum is less than 0.5%, the strength improvement effect is insufficient, while even if it is more than 3%, the effect is less regardless of increased cost. Additionally, excessive addition of molybdenum lowers oxidation resistance of the sintered alloy. Concerning cobalt, if its content is less than 5.5%, hardness at high temperatures of the sintered alloy is insufficient; while if its content exceeds 7.5%, compactability of the raw material powder is deteriorated.

Carbon is added preferably in the form of graphite and in an amount ranging from 0.4 to 1.2% taking account of loss in sintering. A much less added amount of carbon provides an insufficient hardness of the sintered alloy, and therefore a carbon content of not less than 0.3% is preferable after sintering. A too much content of carbon causes cementite to crystallize and causes the hard phase to diffuse over the matrix and decrease thereby deteriorating wear resistance of the sintered alloy. Thus, the carbon content after sintering is 1.1% in upper limit value.

There are two intermetallic compounds suitable for the hard phase as discussed above, i.e., one intermetallic compound consisting essentially of molybdenum ranging from 33 to 36%, silicon ranging from 4 to 12% and balance being substantially cobalt, and the other intermetallic compound consisting essentially of molybdenum ranging from 26 to 30%, chromium ranging from 7 to 9%, silicon ranging from 2 to 3% and balance being substantially cobalt. Of these, the latter containing chromium is better in wear resistance and has a tendency of exhibiting expected characteristics of the sintered alloy in a wide temperature range.

In the sintered alloy according to the present invention, by virtue of addition of nickel powder, austenite structure is formed to be dispersed in the matrix formed of at least one of sorbite and bainite thereby to improve toughness of the whole matrix and minimizing wear of a valve contactable with the valve seat formed of the sintered alloy of the present invention. In general, a sintered alloy of the type wherein hard phase is dispersed therein is improved in wear resistance but tends to be lowered in strength. In this regard, addition of nickel in the present invention is effective for strengthening the matrix and for the purpose of improving performance of the valve seat.

It will be understood that the sintered alloy infiltrated with lead is suitable for the material of a valve seat of a LP-gas fueled engines, while the sintered alloy having no infiltrated lead is suitable for that of engines which are operated on gasoline containing a high rate of lead compound. For diesel engines, it is preferable to use, as the material of a valve seat, the sintered alloys whose sintering temperatures are slightly higher to increase the density of the resultant sintered alloy.

What is claimed is:

1. A high temperature wear resistant sintered alloy comprising a matrix consisting essentially of carbon ranging from 0.45 to 1.15% by weight, nickel ranging from 5.4 to 27% by weight, molybdenum ranging from 0.4 to 2.7% by weight, cobalt ranging from 4.2 to 7.2% y weight, and balance substantially iron, said matrix comprising a mixture of at least one of sorbite structure and bainite structure and austenite structure, said matrix having a hard phase ranging from 5 to 25% by weight and dispersed in said matrix.

2. A high temperature wear resistant sintered alloy consisting essentially of carbon ranging from 0.3- to 1.1% by weight, silicon ranging from 0.2 to 3% by weight, nickel ranging from 5 to 27% by weight, molybdenum ranging from 1.9 to 12% by weight, cobalt ranging from 5 to 23% by weight, and balance being substantially iron, said sintered alloy comprising a matrix consisting essentially of carbon ranging from 0.45 to 1.15% by weight, nickel ranging from 5.4 to 27% by weight, molybdenum ranging from 0.4 to 2.7% by weight, cobalt ranging from 4.2 to 7.2% by weight, and balance being substantially iron, said matrix being formed of a mixture of at least one of sorbite structure and bainite structure and austenite structure, said matrix having a hard phase ranging from 5 to 25% by weight and dispersed in said matrix, said hard phase consisting essentially of silicon ranging from 4 to 12% by weight, molybdenum ranging from 33 to 36% by weight, and balance being substantially cobalt.

3. A high temperature wear resistant sintered alloy as claimed in claim 2, further comprising lead infiltrated in said sintered alloy so that pores of the sintered alloy are filled with lead.

4. A high temperature wear resistant sintered alloy consisting essentially of carbon ranging from 0.3 to 1.1% by weight, silicon ranging from 0.1 to 0.75% by weight, chromium ranging from 0.35 to 2.25% by weight, nickel ranging from 5 to 27% by weight, molybdenum ranging from 1.5 to 10% by weight, cobalt ranging from 5 to 23% by weight, and balance being substantially iron, said sintered alloy comprising a matrix consisting essentially of carbon ranging from 0.45 to 1.15% by weight, nickel ranging from 5.4 to 27% by weight, molybdenum ranging from 0.4 to 2.7% by weight, cobalt ranging from 4.2 to 7.2% by weight, and balance substantially iron, said matrix being formed of a mixture of at least one of sorbite structure and bainite structure and austenite structure, said matrix having a hard phase ranging from 5 to 25% by weight and dispersed in said matrix, said hard phase consisting essentially of silicon ranging from 2 to 3% by weight, chromium ranging from 7 to 9% by weight, molybdenum ranging from 26 to 30% by weight, and balance being substantially cobalt.

5. A high temperature wear resistant sintered alloy as claimed in claim 4, further comprising lead infiltrated in said sintered alloy so that pores of said sintered alloy are filled with lead.

6. A high temperature wear resistant sintered alloy as claimed in claim 1, further comprising lead infiltrated in said sintered alloy so that pores of said sintered alloy are filled with lead.

7. A valve seat for an automotive engine, formed of a high temperature wear resistant sintered alloy comprising a matrix consisting essentially of carbon ranging from 0.45 to 1.15% by weight, nickel ranging from 5.4 to 27% by weight, molybdenum ranging from 0.4 to 2.7% by weight, cobalt ranging from 4.2 to 7.2% by weight, and balance substantially iron, said matrix being formed of a mixture of at last one of sorbite structure and bainite structure and austenite structure, said matrix having a hard phase ranging from 5 to 25% by weight and dispersed in said matrix.

* * * * *